US007207266B2

(12) United States Patent
Heppenstiel et al.

(10) Patent No.: US 7,207,266 B2
(45) Date of Patent: Apr. 24, 2007

(54) PRINTING PRESS

(75) Inventors: Gerhard Heppenstiel, Bammental (DE); Ulrich Luckhardt, Heidelberg (DE); Mathias Zuber, Helmstadt-Bargen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 26 days.

(21) Appl. No.: 11/101,893

(22) Filed: Apr. 8, 2005

(65) Prior Publication Data

US 2005/0223925 A1 Oct. 13, 2005

(30) Foreign Application Priority Data

Apr. 8, 2004 (DE) ..... 10 2004 017 433

(51) Int. Cl.
*B41F 31/15* (2006.01)

(52) U.S. Cl. ..... 101/352.01; 101/350.4; 101/352.06; 101/DIG. 38

(58) Field of Classification Search ..... None
See application file for complete search history.

(56) References Cited

U.S. PATENT DOCUMENTS 4,831,928 A 5/1989 Rebel et al.
5,023,723 A * 6/1991 Date et al. ..... 348/337
5,065,676 A * 11/1991 Hardin ..... 101/350.3
5,201,270 A * 4/1993 Dorsam et al. ..... 101/348
5,713,280 A * 2/1998 Kelm et al. ..... 101/142
6,543,335 B1 * 4/2003 Lassota ..... 99/283
6,691,612 B1 2/2004 Herrmann et al.

FOREIGN PATENT DOCUMENTS

DE 3630491 A1 * 5/1987
DE 44 45 964 A1 6/1996
DE 100 44 860 A1 5/2001
DE 101 18 132 A1 10/2002
EP 0 267 504 A2 5/1988
EP 0 418 778 A2 3/1991
EP 0 668 163 A2 8/1995
GB 2 296 219 A 6/1996

* cited by examiner

*Primary Examiner*—Daniel J. Colilla
*Assistant Examiner*—Jill E. Culler
(74) *Attorney, Agent, or Firm*—Laurence A. Greenberg; Werner H. Stemer; Ralph E. Locher

(57) ABSTRACT

A printing press contains a distributor roller, an oscillating roller which has a roller axle and a roller barrel, and a switching device for optionally releasing, in a first operating mode, and locking, in a second operating mode, an oscillating movement of the roller barrel. The oscillating movement is driven frictionally by the distributor roller. The switching device is disposed separately from the roller axle and the roller axle is mounted so as to be adjustable relative to the switching device.

12 Claims, 3 Drawing Sheets

PRINTING PRESS

BACKGROUND OF THE INVENTION

Field of the Invention

The present invention relates to a printing press containing a distributor roller, an oscillating roller which has a roller axle and a roller barrel, and a switching device for optionally releasing, in a first operating mode, and locking, in a second operating mode, an oscillating movement of the roller barrel. The oscillating movement is driven frictionally by the distributor roll.

A printing press of this type is described in European patent EP 0 418 778 B1 (corresponding to U.S. Pat. No. 5,199,726). According to the prior art, the switching device is disposed on the roller axle and, when the roller axle is displaced, the switching device, which is seated on top of it is displaced together with the roller axle. The displacements of the roller axle serve to set the oscillating roller which functions as an applicator roller onto and off from a form cylinder. The oscillating roller is mounted via roller locks in bearing levers, which are pivoted for throwing it on and off and form an auxiliary frame that serves to displace the roller. It is to be assumed that the auxiliary frame is connected to a main frame of the printing press in a rotationally articulated manner. An imaginary center axis of the switching device and the roller axle are oriented in alignment or coaxially with respect to one another.

An unfavorable aspect of the configuration of the switching device on the roller axle is that, when the roller barrel is locked, only the axial movement play which is present between the roller barrel and the roller axle and which is required for the oscillating movement is eliminated. The axial movement play which is present between the roller axle and the auxiliary frame (bearing lever) and the axial movement play which is present between the auxiliary frame and the main frame and which is necessary for the auxiliary frame to pivot relative to the main frame without jamming are not eliminated by the switching device when the roller barrel is locked. This movement play between the roller axle and the auxiliary frame and between the latter and the main frame makes it possible in an undesirable manner for the distributor roller to move the oscillating roller with it axially in the second operating mode. The axial minimum oscillations which are performed by the roller barrel when it is locked by the switching device, on account of the movement play which has not been eliminated, are large enough to cause printing disturbances despite their small amplitude.

The problem of the minimum oscillations is also not eliminated in the further prior art according to published, non-prosecuted German patent application DE 101 18 132 A1, European patent EP 0 267 504 B1 (corresponding to U.S. Pat. No. 4,831,928) and European patent EP 0 668 163 B1 (corresponding to U.S. Pat. No. 5,119,726).

SUMMARY OF THE INVENTION

It is accordingly an object of the invention to provide a printing press which overcomes the above-mentioned disadvantages of the prior art devices of this general type, which suppresses the minimum oscillations of the roller barrel in the printing press of the generic type mentioned in the introduction.

The printing press according to the invention contains a distributor roller, an oscillating roller which has a roller axle and a roller barrel, and a switching device for optionally releasing, in a first operating mode, and locking, in a second operating mode, an oscillating movement of the roller barrel. The oscillating movement is driven frictionally by the distributor roller. The invention is distinguished by the fact that the switching device is disposed separately from the roller axle and the roller axle is mounted so as to be adjustable relative to the switching device.

In the printing press according to the invention, it is possible to eliminate not only the axial movement play between the roller barrel and the roller axle but, furthermore, also the axial movement play between the roller barrel and the auxiliary frame which serves to displace the roller axle relative to the switching device, and also the axial movement play between the auxiliary frame and the main frame when the roller barrel is locked. The undesirable minimum oscillations of the roller barrel in the second operating mode no longer occur, and the printing disturbances that otherwise result from the minimum oscillations are avoided.

Various developments of the printing press according to the invention are possible.

According to one development, the switching device is a switching spring, by which, in the second operating mode, the roller barrel is loaded axially and tensioned against a stop surface.

According to a further development, the switching device is fastened to a side wall and the roller axle is mounted in a bearing lever which is connected to the side wall via at least one rotational bearing.

According to a further development, the roller barrel is loaded by the switching spring via a locking element that is mounted movably in the bearing lever. The locking element can be a locking plunger.

According to a further development, the roller barrel is loaded by the switching spring via an axial bearing. Here, the roller barrel can be tensioned against the stop surface via another axial bearing.

A further development relates in that the switching spring is a pneumatic cylinder which can be switched by the application of compressed air and which acts as an air spring in the second operating mode. This can be achieved in that, in the second operating mode, the application of compressed air is maintained and, nevertheless, a piston of the pneumatic cylinder does not reach an end position stop.

According to a further development, the oscillating roller is an applicator roller that is in rolling contact with a form cylinder.

A further development relates in that an imaginary center axis of the switching device and the roller axle are oriented so as to be substantially parallel with respect to one another.

Here, the imaginary center axis can be defined by a piston rod.

It is to be noted that the terms roller and cylinder may be used interchangeable throughout the application.

Other features which are considered as characteristic for the invention are set forth in the appended claims.

Although the invention is illustrated and described herein as embodied in a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
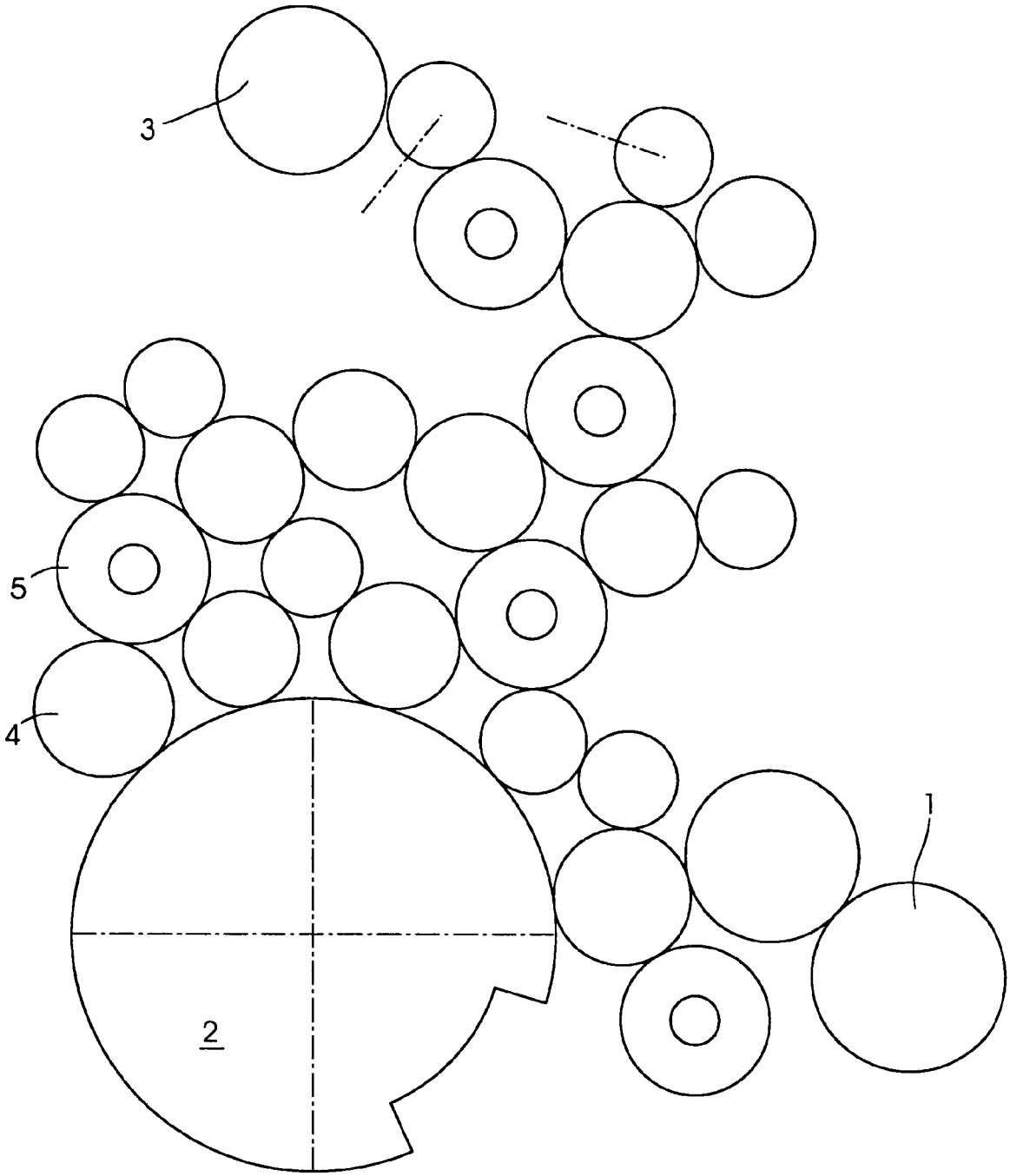
FIG. 1 is an illustration of a printing press.

Referring now to the figures of the drawing in detail and first, particularly, to FIG. 1 thereof, there is shown a printing press 1 for lithographic offset printing. The printing press 1 includes a form cylinder 2 and, for the inking thereof, an inking unit 3 having an applicator roller 4 and a distributor roller 5. A rotational movement of the distributor roller 5 is driven with a form-fitting connection via a non-illustrated gear mechanism. An axial oscillating movement of the distributor roller 5 is driven with a form-fitting connection via a non-illustrated cam mechanism. Both a rotational movement of the applicator roller 4 and an axial oscillating movement of the applicator roller 4 are driven frictionally by the distributor roller 5 via their circumferential surface contact with the latter.

Figure 2:
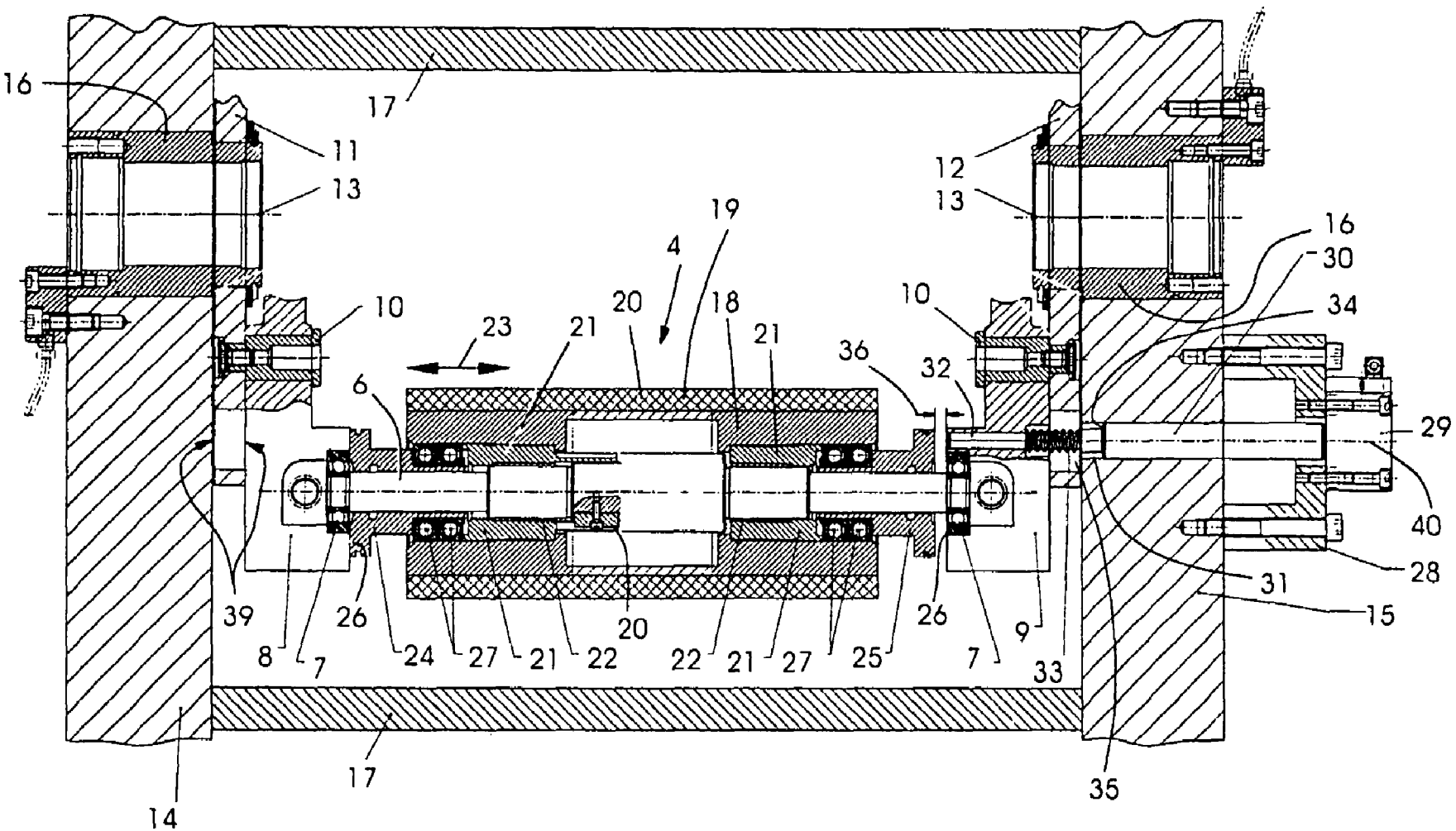
FIG. 2 is a diagrammatic, partial sectional view of the printing press for illustrating a first operating mode of the printing press.

The applicator roller 4 contains a roller axle 6 that is mounted at its axle ends in first and second bearing levers 8, 9 via rotational bearings 7 (FIG. 2). The rotational bearings 7 are roller bearings. The first and second bearing levers 8, 9 are connected in an articulated manner to third and fourth bearing levers 11, 12 via further rotational bearings 10. The third and fourth bearing levers 11, 12 are connected in an articulated manner via further rotational bearings 13 to a first side wall 14 on what is known as the drive side of the printing press 1 and to a second side wall 15 on what is known as the operating side. The further rotational bearings 13 are configured as sliding bearings, like the other rotational bearings 10.

Figure 3:
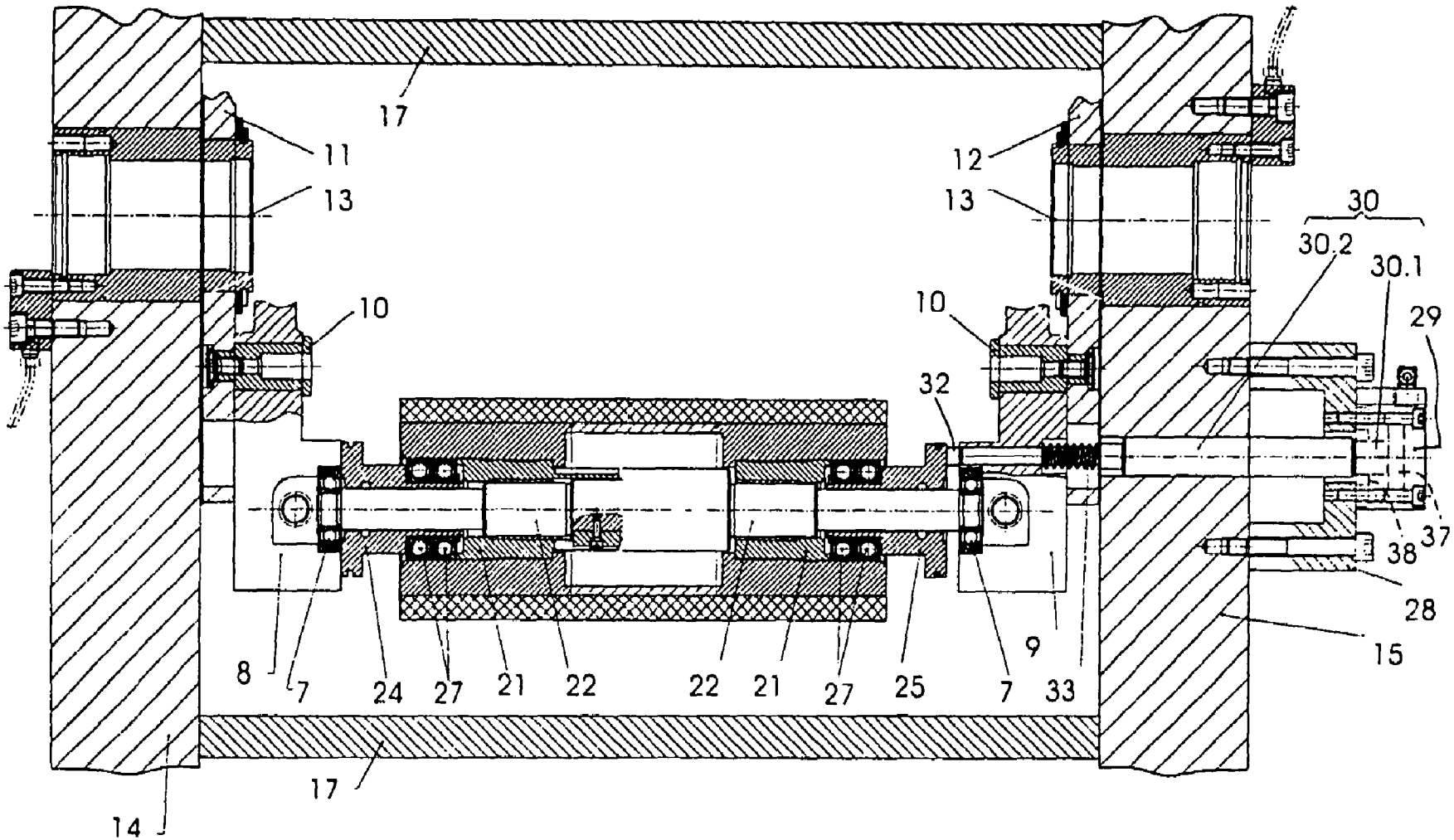
FIG. 3 is a diagrammatic, partial sectional view of the printing press for illustrating a second operating mode of the printing press.

Bearing bushes 16 are seated in the first and second side walls 14, 15, in which bearing bushes 16 the distributor roller 5 is rotatably mounted which is not shown in FIGS. 2 and 3 for reasons of better clarity. The bearing bushes 16 on which the third and fourth bearing levers 11, 12 are seated rotatably form journals of the further rotational bearings 13. When the applicator roller 4 is set onto and off from the form cylinder 2, the third and fourth bearing levers 11, 12 are pivoted about the further rotational bearings 13. The first and second bearing levers 8, 9 are pivoted about the other rotational bearings 10, in order to adjust the circumferential pressure which exists between the applicator roller 4 and the form cylinder 2 when the applicator roller 4 is set against the form cylinder 2. The first and second side walls 14, 15 are connected to one another via cross members 17 which serve for stabilization, and form a machine frame together with the latter.

Apart from the roller axle 6, the applicator roller 4 also contains a sleeve-shaped roller barrel 18 having an elastomeric roller cover 19, the roller barrel 18 being connected fixedly in terms of rotation to the roller axle 6 via what is known as a shaft/hub connection 20. The shaft/hub connection 20 is a feather key connection. The roller barrel 18 is seated fixedly with a press fit on intermediate bushes 21, in which sliding bushes 22 are likewise seated fixedly with a press fit, the sliding bushes 22 sliding relative to the roller axle 6 on the latter during the axial oscillating movement 23 of the roller barrel 18. The feather key groove of the shaft/hub connection 20 has an axial excess length with respect to its feather key, the axial excess length being long enough for the oscillating movement 23. In the oscillating movement 23, the feather key slides to and fro in the feather key groove. The roller barrel 18 is equipped at the ends with a first contact bush 24 and a second contact bush 25, the first and second contact bushes 24, 25 coming into contact alternately with stop surfaces 26 during the oscillating movement 23 and as a result limiting an oscillating width 36 of the oscillating movement 23. The stop surfaces 26 can be configured as flat surfaces on the first and second bearing levers 8, 9, which is preferred, or on the rotational bearings 7 inserted into the latter.

An axial bearing 27 is disposed in each case between the first contact bush 24 and the intermediate bush 21 associated with it, and between the second contact bush 25 and the other intermediate bush 21. The axial bearings 27 are configured as double-row roller bearings and are seated on shoulders of the first and second contact bushes 24, 25.

A pneumatic cylinder 29 is fastened to the second side wall 15 on the outside via a bracket 28. The pneumatic cylinder 29 has a piston rod 30 that is formed of two rod pieces 30.1, 30.2 disposed behind one another in the exemplary embodiment shown and could instead be of a single piece. The piston rod 30 is inserted into a through-opening 31 that is made through the second side wall 15. A locking plunger 32 is seated displaceably in the second bearing lever 9 and is held in permanent contact with the piston rod 30 by a helical restoring spring 33. The restoring spring 33 is fit onto the bolt-shaped locking plunger 32 and is held under pre-stress between its plunger head which is in contact with the piston rod 30 and the second bearing lever 9.

When the applicator roller 4 is set off from the form cylinder 2, the second bearing lever 9 is pivoted together with the fourth bearing lever 12 about its rotational bearing 13. In order that the locking plunger 32 does not impede the pivoting movement serving to throw the roller off, the locking plunger 32 is pushed out of the through-opening 31 by the appropriately actuated pneumatic cylinder 29, counter to the effect of the restoring spring 33. The piston rod 30 has a flat rod end 34 with which the locking plunger 32 is in contact. During the pivoting movement to throw off the roller, the rod end 34 protrudes a little out of the through-opening 31 and the second bearing lever 9 is pivoted with the locking plunger 32 to only such a small extent that the locking plunger 32 passes out of alignment with the piston rod 30 only to a slight extent. Here, a displacement of the head of the locking plunger 32 on the rod end 34 is carried out, in which displacement the flat surfaces that are in contact with one another of the locking plunger 32 and of the rod end 34 do not pass completely out of congruence, however.

In order to prevent locking of the pivoting movement of the fourth bearing lever 12 by the rod end 34 which protrudes out of the second side wall 15 in the previously explained situation, a recess 35 is made in the fourth bearing lever 12, the diameter of which recess 35 is greater than that of the piston rod 30, with the result that the movement space required for the pivoting movement of the fourth bearing lever 12 is provided between the fourth bearing lever 12 and the rod end 34 which protrudes into the latter. The locking plunger 32 extends through the recess 35 when the applicator roller 4 is set against the form cylinder 2, that is to say in the operating modes shown in FIGS. 2 and 3.

In the following text, the method of operation of the switching apparatus for switching the oscillating movement 23 on and off will now be explained.

FIG. 2 shows the operating mode in which the oscillating movement 23 is released by the locking plunger 32. During its axial to and fro movement, the distributor roller 5 that is in contact with the roller barrel 18 drives the roller barrel 18 with it along the roller axle 6. The amplitude of the axial oscillation of the distributor roller 5 is slightly larger than the amplitude of the axial oscillation of the driven roller barrel 18, with the result that the distributor roller 5 moves slightly beyond the dead points, defined by the stop surfaces 26, of the axial oscillation of the roller barrel 18. A distance which exists between the two mutually facing stop surfaces 26 is greater, by the amount of the oscillating width (twice the oscillation amplitude) 36 of the roller barrel 18, than a distance which exists between the two flat surfaces, facing away from one another, of the first and second contact bushes 24, 25. In order to release the oscillating movement 23, the application of compressed air to the pneumatic cylinder 29 is switched off, with the result that its piston rod 30 is pulled in and the restoring spring 33 holds the locking plunger 32 in its release position pulled into the second bearing lever 9, as illustrated in FIG. 2. The piston rod 30 is mounted displaceably in the pneumatic cylinder 29 along a center axis 40 of the pneumatic cylinder 29.

FIG. 3 shows the operating mode in which the oscillating movement of the roller barrel 18 is locked by the locking plunger 32, with the result that the distributor roller 5 moves axially without it being possible to drive the roller barrel 18 with it in the process. In order to lock the oscillating movement 23, compressed air is applied to a piston 37 of the pneumatic cylinder 29 and the piston 37 is extended together with the piston rod 30, with the result that the piston rod 30 presses the locking plunger 32 against the second contact bush 25 under increased stress of the restoring spring 33, so that, as a consequence, the first contact bush 24 is pressed against the stop surface 26 on the drive side, as is illustrated in FIG. 3.

Here, the force which is exerted by the pneumatic cylinder onto the locking plunger 32 flows to the first bearing lever 8 (optionally indirectly via the drive-side rotational bearing 7) in the order mentioned in the following text, via the second contact bush 25, the axial bearing 27 seated on the latter, the operating-side intermediate bush 21, the roller barrel 18, the drive-side intermediate bush 21, the drive-side axial bearing 27, the first contact bush 24, with the result that the first bearing lever 8 is pressed against the third bearing lever 11, and the third bearing lever 11 is pressed against the first side wall 14. Whether the force flux is transmitted from the first contact bush 24 directly to the first bearing lever 8 or, instead, indirectly to the first bearing lever 8 via the rotational bearing 7 seated in the first bearing lever 8 is dependent on whether the drive-side stop surface 26 is situated on the first bearing lever 8 or on the rotational bearing 7.

It is decisive that, when the roller barrel 18 is locked, the pneumatic cylinder 29 acts as a gas pressure spring or air spring, which is ensured by corresponding dimensioning of the components that participate in the force flux. The components are dimensioned in such a way that, when compressed air is continuously applied to the pneumatic cylinder 29 and the latter holds the locking plunger 32 in the locking position (see FIG. 3), the piston rod 30 has not yet extended fully, with the result that the piston 37 has not yet reached an end position stop 38 of the pneumatic cylinder 29, which end position stop 38 otherwise limits the complete extension of the piston rod 30. The device for applying compressed air and the end position stop 38 are situated on opposite sides relative to the piston 37. The pneumatic cylinder 29 therefore functions as a resiliently acting switching element which eliminates an axial bearing play of the drive-side rotational bearings 10 and 13 via the discussed force flux while the roller is locked.

The bearing play is necessary for the jam-free pivoting of the first bearing lever 8 and of the third bearing lever 11 and, when the axial locking of the applicator roller 4 is switched off, is demonstrated in the form of minimum movement gaps between the first bearing lever 8 and the third bearing lever 11, and also between the latter and the first side wall 14, as is indicated diagrammatically in FIG. 2 by the corresponding designations "39".

The invention is based on the now described findings. The axial bearing play and the movement gaps 39 would permit axial minimum oscillations of the roller barrel 18 corresponding to their size, if the pneumatic cylinder 29 were extended fully when the roller barrel 18 is locked, with the result here that the piston 37 would be in contact with the end stop 38 and, as a consequence, the pneumatic cylinder 29 would no longer act resiliently or as an air spring. Furthermore, it has been shown in experiments that the axial minimum oscillations could certainly cause printing disturbances, even if their oscillating width is only from 0.5 mm to 1.0 mm. The printing disturbances would manifest themselves in the form of the increased formation of stripes in the printed image and in the undesirable acceptance of ink by locations that should be kept free of ink on the planographic printing form that is situated on the form cylinder 2, what is known as scumming. Proceeding from this, it has been recognized that, in order to avoid the minimum oscillations, it is necessary, while the roller is locked axially, not only to resiliently tension the applicator roller 4 with its actuating device (auxiliary frame) which serves to throw the roller on and off and to which the first bearing lever 8 and the third bearing lever 11 belong, but also to resiliently tension this actuating device in itself and with the first side wall 14, with the result that there are practically no more movement gaps 39 and, as a consequence, the oscillating distributor roller 5 of the actuating device and the applicator roller 4 can no longer exert the minimum oscillations.

The pneumatic cylinder 29 is used for the resilient tensioning, and a hydraulic cylinder could also be used instead, on the piston rod end of which a helical compression spring is seated which, while the roller is locked, is held under pre-stress between the head of the locking plunger 32 and the piston rod end; it would be necessary for this compression spring to be much stronger or stiffer than the restoring spring 33. Generally speaking, a switching spring, that is to say a spring that can be switched as desired into two positions (locking position, release position), is required for the resilient tensioning. One spring end of the switching spring is pre-stressed against the applicator roller, optionally indirectly via one or more intermediate elements such as the locking plunger 32, and the other spring end of the switching spring is pre-stressed against the machine frame or its side wall 15, optionally via one or more intermediate elements such as the bracket 28. The machine frame containing the side wall 15 describes what is known as the main frame and not an auxiliary or movement frame which is formed by the bearing levers 8, 9, 11, 12.

Supporting the switching spring between said auxiliary or movement frame and the applicator roller 4 and holding it under pre-stress would not namely lead to the technical success, the elimination of the movement play which is present between the auxiliary or movement frame and the main frame.

According to a modification, which is not shown in the drawing, it is also possible to use another locking element, such as a locking eccentric, instead of the locking plunger 32.

This application claims the priority, under 35 U.S.C. § 119, of German patent application No. 10 2004 017 433.4, filed Apr. 8, 2004; the entire disclosure of the prior application is herewith incorporated by reference.

We claim:

1. A printing press, comprising:

a distributor roller;

an oscillating roller having a roller axle and a roller barrel, said roller axle being mounted in a bearing lever; and a switching device for optionally releasing, in a first operating mode, and locking, in a second operating mode, an oscillating movement of said roller barrel, said oscillating movement being driven frictionally by said distributor roller, said switching device disposed separately from said roller axle, and said roller axle together with said bearing lever being adjustably mounted relative to said switching device.

2. The printing press according to claim 1, further comprising a stop surface and said switching device is a switching spring, by which, in the second operating mode, said roller barrel is loaded axially and tensioned against said stop surface.

3. The printing press according to claim 2, further comprising:

a side wall, said switching device being fastened to said side wall;

at least one rotational bearing; and said bearing lever connected to said side wall through said at least one rotational bearing.

4. The printing press according to claim 3, further comprising a locking element mounted movably in said bearing lever, said roller barrel is loaded by said switching spring via said locking element.

5. The printing press according to claim 4, wherein said locking element is a locking plunger.

6. The printing press according to claim 2, further comprising an axial bearing, said roller barrel is loaded by said switching spring via said axial bearing.

7. The printing press according to claim 6, further comprising a further axial bearing and said roller barrel is tensioned against said stop surface via said further axial bearing.

8. The printing press according to claim 2, wherein said switching spring is a pneumatic cylinder which can be switched by an application of compressed air and which acts as an air spring in the second operating mode.

9. The printing press according to claim 8, wherein said pneumatic cylinder has a piston and an end position stop, in the second operating mode, the application of compressed air is maintained and, nevertheless, said piston of said pneumatic cylinder does not reach said end position stop.

10. The printing press according to claim 1, further comprising a form cylinder, said oscillating roller is an applicator roller which is in rolling contact with said form cylinder.

11. The printing press according to claim 1, wherein each of said switching device and said roller axle have an imaginary center axis oriented so as to be substantially parallel with respect to one another.

12. The printing press according to claim 11, wherein said switching device has a piston rod, and said imaginary center axis of said switching device is defined by said piston rod.

* * * * *